US006511097B2

(12) United States Patent
Dahlquist

(10) Patent No.: US 6,511,097 B2
(45) **Date of Patent: *Jan. 28, 2003**

(54) COUPON BOOKLET AND METHOD

(75) Inventor: Ake L. Dahlquist, Dixon, IL (US)

(73) Assignee: Sleepeck Printing Company, Dixon, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 2 days.

(21) Appl. No.: 09/506,191

(22) Filed: Feb. 17, 2000

(65) Prior Publication Data

US 2001/0040371 A1 Nov. 15, 2001

(51) Int. Cl.[7] ..... B42D 1/00

(52) U.S. Cl. ..... 281/15.1; 281/2; 281/3.1; 283/61; 283/105

(58) Field of Search ..... 281/2, 5, 3.1, 14, 281/15.1; 283/56, 61, 62, 105, 63.1, 51, 52, 64.1; 40/107, 118, 119, 121

(56) References Cited

U.S. PATENT DOCUMENTS

| | | | | | |
|---|---|---|---|---|---|
| 314,170 | A | * | 3/1885 | Eastman | |
| 918,280 | A | * | 4/1909 | Catlett et al. | |
| 1,101,346 | A | * | 6/1914 | Smith | |
| 1,110,367 | A | * | 9/1914 | Wood | |
| 1,161,580 | A | * | 11/1915 | Allen | |
| 1,478,130 | A | * | 12/1923 | Marsh | |
| 2,322,647 | A | * | 6/1943 | Luce | |
| 2,755,576 | A | * | 7/1956 | Golden | |
| 3,275,316 | A | * | 9/1966 | Clearly | |
| 3,520,560 | A | * | 7/1970 | Issac | |
| 3,582,111 | A | * | 6/1971 | Siiter | 283/56 |
| 3,588,085 | A | * | 6/1971 | Bailey | 283/56 |
| 3,899,381 | A | * | 8/1975 | O'Brien et al. | 156/204 |
| 3,945,870 | A | | 3/1976 | Johnsen | 156/201 |
| 4,010,964 | A | * | 3/1977 | Schechter | 283/56 |
| 4,084,823 | A | | 4/1978 | Haggedal | 273/269 |
| 4,108,352 | A | | 8/1978 | Peschke | 229/69 |
| 4,146,983 | A | | 4/1979 | Penick et al. | 40/124.1 |
| 4,193,498 | A | | 3/1980 | Rowling | 206/494 |
| 4,200,945 | A | * | 5/1980 | Ellis | 281/15 A |
| 4,288,077 | A | | 9/1981 | Rose et al. | 273/246 |
| 4,305,605 | A | * | 12/1981 | Vine | 281/35 |
| 4,441,739 | A | | 4/1984 | Cluff et al. | 281/16 |
| 4,479,838 | A | | 10/1984 | Dunsirn et al. | 156/247 |
| 4,614,364 | A | | 9/1986 | Bortner | 283/45 |
| 4,703,933 | A | | 11/1987 | Cahill et al. | 273/139 |
| 4,717,176 | A | | 1/1988 | Matthews | 281/15 R |
| 4,887,373 | A | * | 12/1989 | Macaulay | 281/38 |
| 4,934,740 | A | * | 6/1990 | Drake | 282/8 R |
| 4,997,205 | A | * | 3/1991 | Hansch | 281/2 |
| 5,002,447 | A | * | 3/1991 | Borel | 412/6 |
| 5,015,137 | A | | 5/1991 | Stenner | 412/1 |
| 5,038,999 | A | | 8/1991 | Dicker | 229/69 |
| 5,104,146 | A | | 4/1992 | Schulz et al. | 281/15.1 |
| 5,154,344 | A | | 10/1992 | Loch | 229/304 |
| 5,223,076 | A | | 6/1993 | Walter | 156/538 |

(List continued on next page.)

*Primary Examiner*—A. L. Wellington
*Assistant Examiner*—Monica Carter
(74) *Attorney, Agent, or Firm*—Ryndak & Suri

(57) ABSTRACT

A booklet is provided which is easily formed in the in-line finishing process part of a web printing press operation having a plurality of sheets or layers, each sheet or layer having multiple removable portions positioned about a central portion used to attach the layers or sheets to one another. The removable portions of the booklet are particularly useful as coupons, advertising material or the like. The booklet may be attached to a newspaper, magazine, catalog or the like by extending the outer edge of one of the removable portions so such outer edge can be attached to the newspaper, magazine, or the like. The booklet may also be removable from the newspaper, magazine, catalog or the like by placing perforations between the attachable extension and the outer removable portion. Also provided is a method of making the inventive booklet.

22 Claims, 4 Drawing Sheets

U.S. PATENT DOCUMENTS 5,267,898 A 12/1993 Doll et al. ..... 462/6
5,284,363 A 2/1994 Gartner et al. ..... 283/81
5,292,154 A * 3/1994 Williams ..... 283/2
5,299,833 A * 4/1994 Madole, Jr. ..... 281/2
5,299,835 A * 4/1994 Sonnenberg ..... 253/56
5,314,176 A 5/1994 Schmitt ..... 270/1.1
5,334,432 A * 8/1994 Long ..... 428/43
5,354,098 A * 10/1994 Mills ..... 283/67
5,366,145 A 11/1994 Sauerwine ..... 229/304
5,433,317 A 7/1995 Roser ..... 206/232
5,547,225 A * 8/1996 Deangelis ..... 281/211
5,716,688 A 2/1998 Burke et al. ..... 428/43
5,727,817 A 3/1998 Kraige ..... 283/51
5,768,812 A * 6/1998 Cross ..... 40/120
5,792,536 A 8/1998 Whipp ..... 428/40.1
5,799,981 A 9/1998 Tung et al. ..... 283/56
5,826,914 A * 10/1998 Hudetz ..... 283/61
5,837,338 A 11/1998 Rich et al. ..... 428/42.3
5,863,372 A 1/1999 Fabel ..... 156/277
5,874,142 A 2/1999 Hoffmann ..... 428/40.1
5,884,944 A 3/1999 Durham ..... 283/67
5,887,366 A 3/1999 Volkert et al. ..... 40/124.08
5,890,741 A 4/1999 Hollander ..... 283/62
5,918,905 A * 7/1999 Wilen ..... 281/16
5,918,908 A * 7/1999 Barnett et al. ..... 283/56
6,203,070 B1 * 3/2001 Richardson ..... 283/117

* cited by examiner

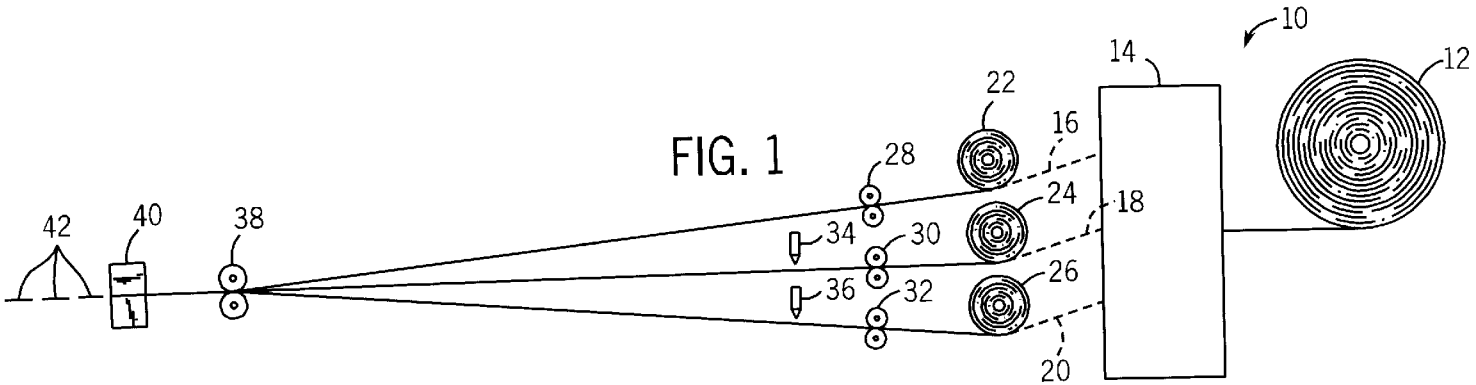
FIG. 1
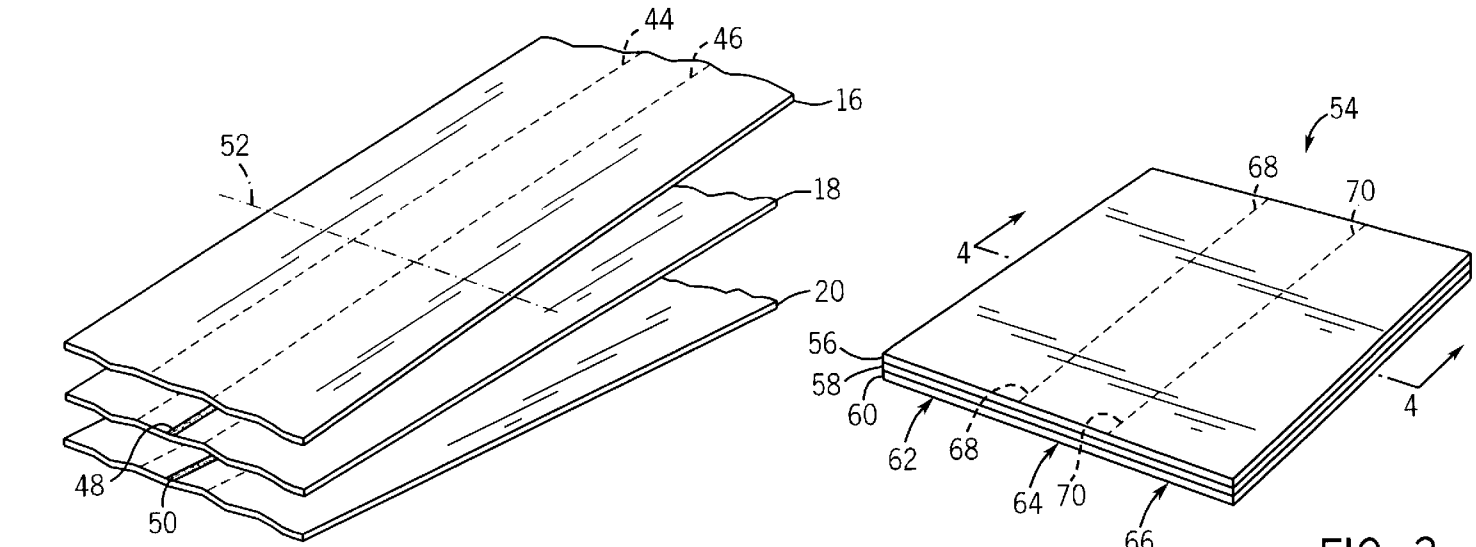
FIG. 2
FIG. 3

COUPON BOOKLET AND METHOD

FIELD OF THE INVENTION

The present invention relates to advertising material in a booklet form and particularly to removable, indicia-bearing advertising materials which may be redeemed for value. The present invention also relates to a method of making such advertising material.

BACKGROUND OF THE INVENTION

Advertising, especially through coupon use and redemption, is a particularly effective way for companies to promote new products and revive older brands. However, coupon redemption rates tend to be low across the general consumer population. Thus, to be effective, coupons and inserts need to be not only attractive and attention-getting to the ultimate consumer but must also be easy to access and use, otherwise the consumer will abandon the coupon use altogether. Moreover, the coupon must be relatively inexpensive to manufacture, and the overall coupon design must be compatible for easy printing on a high-speed web press.

Consequently, a need exists for a coupon booklet with removable portions that is attractive to the end user, easy to use and inexpensive to manufacture. A need also exists for a method of making the same which is inexpensive, efficient, and compatible to use with existing web printing presses equipped with in-line finishing capabilities.

SUMMARY OF THE INVENTION

The present invention provides an economically produced booklet for advertising which comprises a plurality of removable portions that are particularly suitable for use as coupons or for any other desired use. The booklet comprises a plurality of sheets or layers that are divided generally into (a) a central portion where the layers of the booklet are longitudinally attached to one another and (b) two outer removable portions flanking the central portion. The outer removable portions are intended to be printed with indicia and removed from the booklet and used, as desired, for example, as coupons. The outer removable portions are separable from the central portion through perforations or other lines of weakness. Alternatively, an attachment portion may be provided along one of the outer peripheries of the booklet to allow the booklet to be attached to a magazine, catalog, newspaper or the like. The attachment portion is preferably detachable from the booklet through perforations or lines of weakness.

In accordance with another aspect of the invention, a booklet is provided, comprising a plurality of sheets having two lines of weakening which define a boundary between a central sheet portion and outer removable portions on each side of the central sheet portion, each line of weakening being suitable for facilitating the separation of the outer sheet portions from the central portion. An attachment joins the sheets together into a booklet. The outer removable sheet portions are intended to be printed with indicia and used as coupons, for example. Preferably, the two lines of weakening which define the boundary between the central sheet portion and outer removable portions comprise perforations, but any suitable line of weakening known in the art will suffice, including lines of weakness or punches.

In accordance with yet another aspect of the invention, an additional line of weakening may be provided in the aforedescribed booklet which defines a boundary between at least one outer periphery of at least one of the sheets and an attachable sheet portion, the line of weakening being suitable to facilitate the removal of the attachable sheet portion from the at least one periphery of at least one of the sheets. Preferably, the line of weakening comprises a line of perforations, but any suitable line of weakening will suffice.

In accordance with another aspect of the invention, a method is provided for manufacturing a booklet having a plurality of removable portions. The method comprises conveying a plurality of webs, bringing the webs into registry, and attaching the webs together along a central longitudinal portion of the webs. The webs are also provided with two longitudinal lines of weakening, such as perforations or lines of weakness, which define a boundary between a central longitudinal portion of the web and outer removable portions of the web. These two longitudinal lines of weakening are suitable for facilitating the removal of the outer portions of the web from the central longitudinal portion of the web. The webs are also transversely cut into individual booklets. The method of the present invention may further include a step of forming a line of weakening adjacent to an outer edge of the booklet, which line of weakening defines a boundary between a removable attachment portion and the outer edge of the booklet. The line of weakening so formed facilitates the detachment of the removable attachment portion from the outer edge of the booklet.

It is to be understood that the removable portions may comprise one or more panels that can be folded over.

BRIEF DESCRIPTION OF THE DRAWINGS

FIG. 1 is a schematic elevation view of the machinery and webs used for producing the booklet of the present invention;

FIG. 2 is an enlarged perspective view of a portion of the webs shown in vertical registry in FIG. 1;

FIG. 3 is perspective view of the booklet of the present invention;

DETAILED DESCRIPTION OF THE INVENTION

Figure 4:
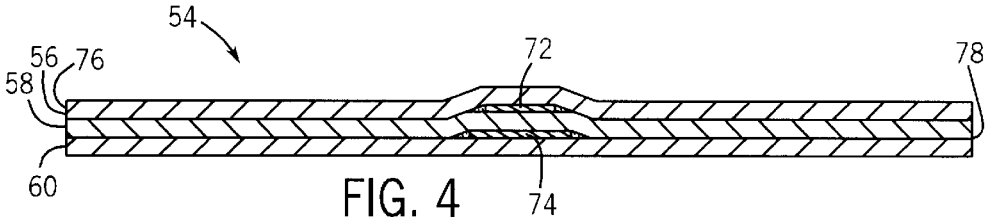
FIG. 4 is a sectional view of the booklet of FIG. 3 through line 4—4.

As used herein, the term "web" means an elongated strip of paper or other material, regardless of origin. Thus, a web may originate from an original roll of paper or a portion thereof, or it may be slit from a larger strip or web of material.

Referring to FIG. 1, a web press assembly line 10 for forming the inventive booklet is shown in a schematic elevation view. Preferably, a web 12 of material preprinted with suitable indicia is provided for the construction of the present invention. Web 12 is slit at slitting station 14 into three smaller webs 16, 18, and 20. More webs could be provided, but three webs are shown here for illustration. The separated webs of material 16, 18 and 20 are then guided into vertical registry by rollers 22, 24, and 26, respectively. After webs 16, 18, and 20 are brought into vertical registry, the webs are provided with a suitable line, or lines, of weakening for easy removal of portions of the webs as later described. The line, or lines, of weakening may be of any suitable form known in the art which introduces a "weakness" into the web at the point of the line so that the web can be separated into two portions. Preferably, the line of weakening comprises a longitudinal line of perforations. However, the line of weakening may also, for example, comprise longitudinal lines of holes, indentations, creases, or any other suitable form that introduces weakness. Perforation may occur by any means well known in the art, including perforating wheels or punch devices, for example. FIG. 1 shows perforating wheels 28, 30, and 32 as creating the line of weakening in webs 16, 18 and 20. Alternatively, the line of weakening may be scored into webs 16, 18, and 20, as is well known in the art.

After the line of weakening is formed in webs 16, 18, and 20, a suitable adhesive is applied by dispensers 34 and 36. Alternatively, the adhesive can be applied concurrently with the formation of such line of weakening. The adhesive is applied between each of webs 16, 18, and 20. Suitable joining means include, for example, adhesives (pressure-sensitive and not pressure-sensitive), glues, pastes, staples, ties or any other means for joining known in the art. After the adhesive is applied, webs 16, 18, and 20 are married together by rollers 38 and are cut transversely at cutting station 40 into individual booklets 42 that are suitable for consumer use. Preferably, the transverse cut is straight and perpendicular to the outer edges of the webs. Alternatively, the transverse cut may be angled, wavy or non-uniform to provide an aesthetically different and interesting appearance to booklets 42.

Although this sequence for producing the present prevention is preferred, one skilled in the art will realize that the steps cited above need not occur in the specified order. For instance, the line of weakening suitable for easily removing portions of the webs may be provided after all of the sheets have been brought into registry and married. Further, adhesive need not be applied prior to marriage of the webs, as mechanical fasteners may be used to join the webs together, for example. Additionally, web 12 need not be a single web but may be a plurality of webs already joined as described above.

Moving to FIG. 2, an enlarged perspective view is shown of webs 16, 18, and 20 in registry prior to marriage. As can be seen in this view, webs 16, 18, and 20 have lines of weakening 44 and 46, which are suitable for removing a portion of the webs to be used as indicia-bearing coupons or the like, as described below. At the depicted stage of manufacture, adhesive 48 and 50 is applied to join the webs together. Straight transverse line 52 depicts where the webs will be cut to form individual booklets 42.

FIG. 3 shows a perspective view of a completed booklet 54 in accordance with the invention, having detachable portions made according to the process described above. Booklet 54 is shown consisting of three layers 56, 58, and 60, which in this embodiment are made of paper. Layers 56, 58, and 60 are portions of web cut from webs 16, 18, and 20. It is to be understood that in accordance with the invention, booklet 54 may be configured to comprise at least two layers of web material. For example, booklet 54 can be made of three or more sheets according to the present invention. The sheets or layers are preferably made of paper, and each may be of the same or different paper or web stock, may have the same or different weight or caliper, and may be either coated or uncoated. Alternatively, sheets or layers 56, 58, and 60 can be made of any of the different types of web stock known in the art, including, for example, plastic, metal or other suitable material, which may also be of different weight web stock and may be coated or uncoated. Indeed, the sheet or layer material is not limited to web stock, as the booklet may be produced by a process other than by a conventional web press.

Preferably, sheets or layers 56, 58, and 60 of the booklet are of the same or similar size. However, the size of the individual sheets or layers can be varied. For example, the sheets may be arranged in a pyramidal-type fashion so that each successive sheet is smaller than the sheet on which it sets.

The sheets or layers of the booklet are attached to each other preferably with an adhesive, which is not shown in FIG. 3. The adhesive is preferably permanent, but any suitable adhesive may be used. The sheets can also be attached by other means known in the art, including the use of fasteners, staples, ties, or the like.

In FIG. 3, each sheet 56, 58, and 60 of booklet 54 comprises three portions—i.e., two outer removable portions 62 and 66, and a central joining portion 64. Line of weakening 68 defines the point of intersection between outer portion 62 and central joining portion 64 and facilitates removal or separation of outer portion 62 from central joining portion 64. Line of weakening 68 may be a longitudinal line of perforations, weakness, or punched holes, for example. Similarly, line of weakening 70 defines the boundary between outer portion 66 and central joining portion 64 and facilitates removal of outer portion 66 from central joining portion 64.

Outer portions 62 and 66 are preferably wider than joining portion 64. Outer portions 62 and 66 are preferably of equal width, but either outer portion 62 or 66 may be wider than the other outer portion. Producing an outer portion 62 or 66 which is wider than the other outer portion is readily achieved by offsetting the central joining portion 64 from the longitudinal mid-line of booklet 54. Outer portions 62 and 66 are preferably preprinted with indicia and are intended to be removed from booklet 54 for use as coupons or the like. Joining portion 64 may likewise be printed with indicia for advertising; however, joining portion 64 is intended to hold sheets 56, 58, and 60 of booklet 54 together and may be discarded after all portions 62 and 66 of sheets 56, 58, and 60 have been removed from booklet 54.

In an alternative embodiment (not shown), at least one of the panels may terminate at the line of weakening so that such panel comprises one detachable outer portion and one panel for attaching to an adjacent sheet.

In yet another embodiment (not shown), each sheet of the booklet may include four panels formed by three lines of weakening. This embodiment includes two outer removable portions, one removable portion enclosed between lines of weakening, and one panel that is bound to an adjacent sheet by a suitable means of attachment that joins the sheets together into a booklet. In this embodiment, both the outer removable sheet portions and the removable-enclosed portions are intended to be printed with indicia and used as coupons, for example.

FIG. 4 shows a cross-sectional view of booklet 54 taken along line 4—4 of FIG. 3. In this embodiment, sheets 56 and 58 are joined together by a layer or bead of adhesive 72. Similarly, sheets 58 and 60 are joined together by a layer or bead of adhesive 74. In this embodiment, sheets 56, 58, and 60 are of equal width and have uniform outer edges 76 and 78 which impart a "finished" look to booklet 54. Alternatively, outer edges 76 and 78 may be contoured in appearance and form, as if formed by tearing, for example.

Figure 5:
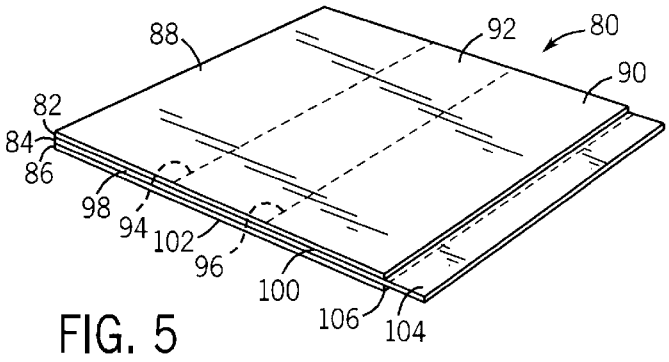
FIG. 5 is a perspective view of another embodiment of the present invention.

Referring now to FIG. 5, another aspect of the present invention is depicted wherein booklet 80 is intended to be inserted into a magazine, newspaper, catalog, or the like. In this embodiment, booklet 80 is formed by three sheets 82, 84, and 86 of material as described above. Sheets 82 and 86 are similarly divided into outer portions 88 and 90 and central joining portion 92. The boundary between outer portion 88 and central portion 92 is defined by longitudinal line of weakening 94 which facilitates removal of outer portion 88 from booklet 80. Similarly, the boundary between outer portion 90 and central joining portion 92 is defined by line of weakening 96, which facilitates removal of outer portion 90. In this embodiment, sheet 84 is configured similarly to sheets 82 and 86, but is wider than sheets 82 and 86. Sheet 84 has two outer portions 98 and 100 which are intended to be removable portions. Sheet 84 also has a central joining portion 102, which joins sheet 84 to sheets 82 and 86. Additionally, wider sheet 84 has an attachment portion 104 for attaching booklet 80 to a magazine, newspaper, catalog, or the like by use of a suitable adhesive or other joining means, as described above. Line of weakening 106, similar to lines of weakening 96 or 94, allows for easy separation or removal of portion 100 from attachment portion 104 and defines the boundary between portions 100 and 104 of sheet 84. In this embodiment, line of weakening 106 is formed slightly outside of the edge of sheets 82 and 86. Preferably, attachment portion 104 is the narrowest of all portions 98, 100, and 102 and is only wide enough to secure booklet 80 to a publication, such as those described above. As booklet 80 is distributed along with the magazine, newspaper, catalog, or the like, it is easily removed from the accompanying publication by separating portions 100 and 104 of sheet 84 from one another along line of weakening 106. Attachment portion 104 remains joined to the magazine, newspaper, catalog, or the like after booklet 80 is separated therefrom. In a preferred embodiment, line of weakening 106 is weaker than line of weakening 96 so that a separation more easily occurs along line of weakening 106 than line of weakening 96. The separation of portion 100 from attachment portion 104 of sheet 84 additionally allows portion 100 to be removed and used in the same manner as portions 88 and 90. It is to be understood that any suitable or desired number of sheets 82, 84 and 86 can be extended with a bind-in strip 104.

Figure 6:
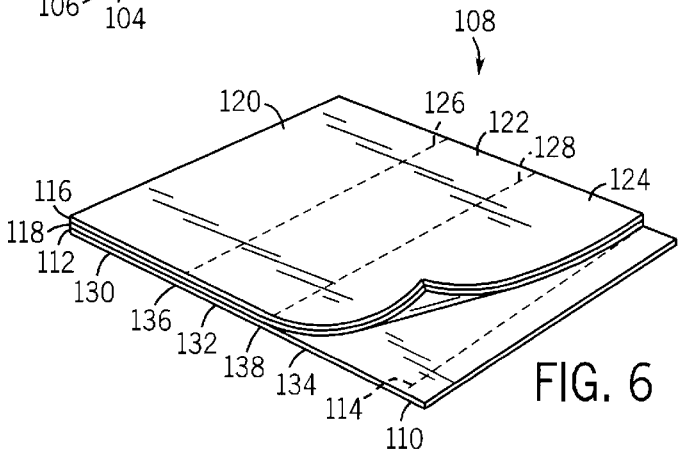
FIG. 6 is a perspective view of yet another embodiment of the present invention.

FIG. 6 shows a perspective view of another embodiment of the present invention with sheets pulled-back. Booklet 108 comprises sheets 116, 118, and 112. Booklet 108 is similar to booklet 80 shown in FIG. 5. The only differences between booklet 80 and booklet 108 center on the sheet from which the attachment portion extends and where the line of weakening that is adjacent the attachment portion lies with respect to the outer edge. In booklet 80, attachment portion 104 extends from the wider middle sheet 84, and line of weakening 106 is set slightly out from the edge of sheets 82 and 86. In contrast, in booklet 108, attachment portion 110 extends from wider outer sheet 112, and line of weakening 114, which facilitates separation of attachment portion 110 from the rest of outer sheet 112, is flush with the edge of sheets 116 and 118. Outer sheet 112 can be the top sheet of booklet 108; in an alternative embodiment, outer sheet 112 can be the bottom sheet. The flush position of line of weakening 114 with respect to the edge of sheets 116 and 118 provides an even edge when portion 110 is separated from the remainder of outer sheet 112. Sheets 116 and 118 are divided into three portions—two outer portions 120 and 124, and a central joining portion 122. Again, portions 120 and 124 are preferably printed with indicia to be utilized as coupons or the like. Line of weakening 126, suitable for facilitating the removal of portion 120 from 122, defines the boundary between portions 120 and 122. Similarly, line of weakening 128, which facilitates removal of portion 124 from portion 122 defines the boundary between such portions. Outer layer 112 comprises four portions 130, 132, 134, and 110. Line of weakening 114 defines the boundary between attachment portion 110 and portion 134. Line of weakening 136, which facilitates removal of portion 130 from portion 132, defines the boundary therebetween. Likewise, line of weakening 138, which facilitates removal of portion 134 from central joining portion 132, defines the boundary between portions 132 and 134. Any attachment portion need not extend beyond the periphery of sheets not having an attachment portion.

Figure 7:
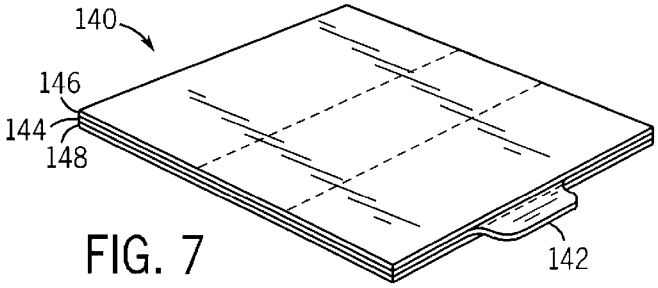
FIG. 7 is a perspective view of still another embodiment of the present invention.

Referring to FIG. 7, a perspective view of still another aspect of the present invention is depicted. Booklet 140 is constructed the same as booklet 80 in FIG. 5 in all respects, except that attachment portion 104 of booklet 80 is replaced with tab portion 142 in booklet 140. Tab portion 142 of sheet 144 is produced from the action of a die-cut assembly known in the art. Typically, tab 142 is cut from an attachment portion similar to portion 104 in FIG. 5. Tab 142 may be cut from sheet 144 preferably before sheets 144, 146, and 148 are married together before being cut transversely into booklet form. If tab 142 is cut after marriage of sheets 144, 146, and 148, care must be taken not to allow the die-cut assembly to remove pieces from or cause tearing of either sheet 146 or 148. Each layer can have its own "index" tab such as tab 142, if desired.

Figure 8:
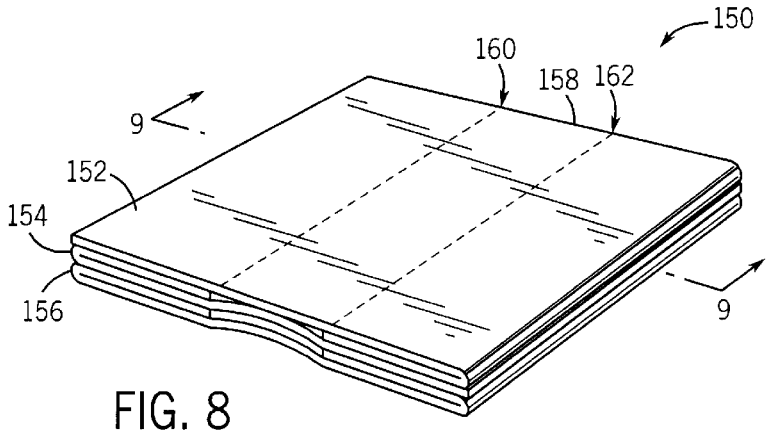
FIG. 8 is a perspective view of another embodiment of the present invention.
Figure 9:
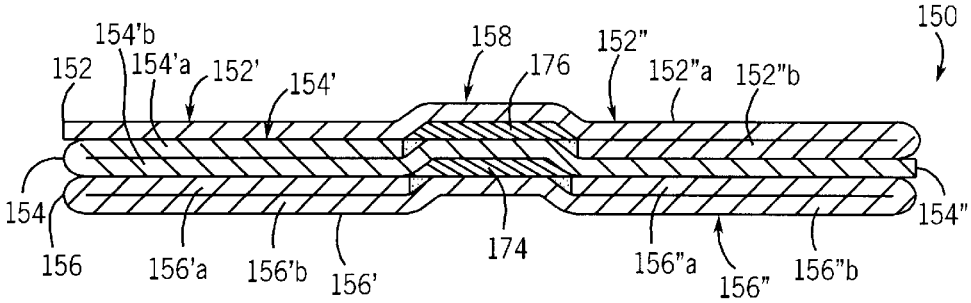
FIG. 9 is a sectional view of the booklet of FIG. 8 through line 9—9.
Figure 10:
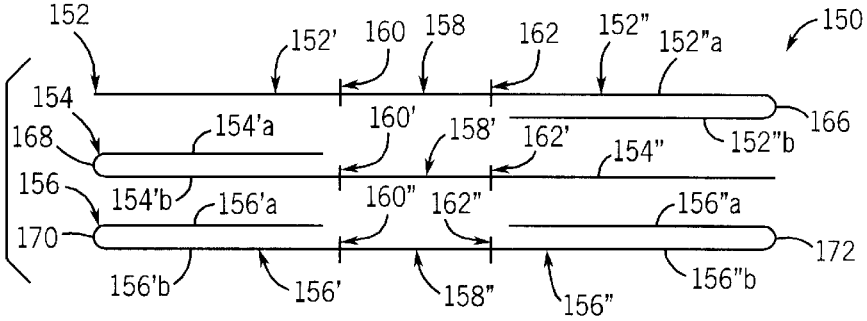
FIG. 10 is an exploded schematic illustration of the booklet of FIG. 8.

Referring to FIGS. 8–10, there is illustrated another embodiment in accordance with the present invention. FIG. 8 shows a perspective view of booklet 150, and FIG. 9 shows a cross-sectional view of booklet 150 taken along line 9—9 of FIG. 8. Booklet 150 is constructed in a manner similar to booklet 80, previously described with respect to booklet 54 illustrated in FIG. 3. However, the sheets or layers 152, 154 and 156 of booklet 150 are different. While sheets or layers 152, 154 and 156 have a central joining portion 158 with lines of weakening 160 and 162, sheets or layers 152,154 and 156 have outer portions 152' and 152", 154' and 154" and 156' and 156" that can be composed of multiple panels, as illustrated. For example, outer portions 152", 154', 156' and 156" are each composed of two panels: 152"*a*, 152"*b*, 154'*a*, 154'*b*, 156'*a*, 156'*b*, 156"*a* and 156"*b*, respectively, as more clearly illustrated in FIG. 10. FIG.10 is an exploded, schematic view of sheets 152,154 and 156 of booklet 150 without glue 174 and 176 illustrating the various folds and panels of booklet 150. Lines of weakening 160 and 162 are illustrated for each of sheets 152, 154 and 156 with reference numerals 160/162, 160'/162' and 160"/162", respectively as are central joining portions 158,158' and 158". The various panels are made by making appropriate folds 166, 168,170 and 172 in each of sheets or layers 152,154 and 156 as illustrated. Typically, folds 166–172 will be made prior to the attaching of sheets 152, 154 and 156 with glue 174 and 176. Such folds may be made by any suitable method using any suitable equipment as is known in the art.

In accordance with the invention, various numbers and combinations of roll folds and Z-folds may be utilized so that the removable portions are not limited to the type and number of panels illustrated in FIGS. 8–10. Examples of several such embodiments are depicted in FIGS. 11–13.

Figure 11:
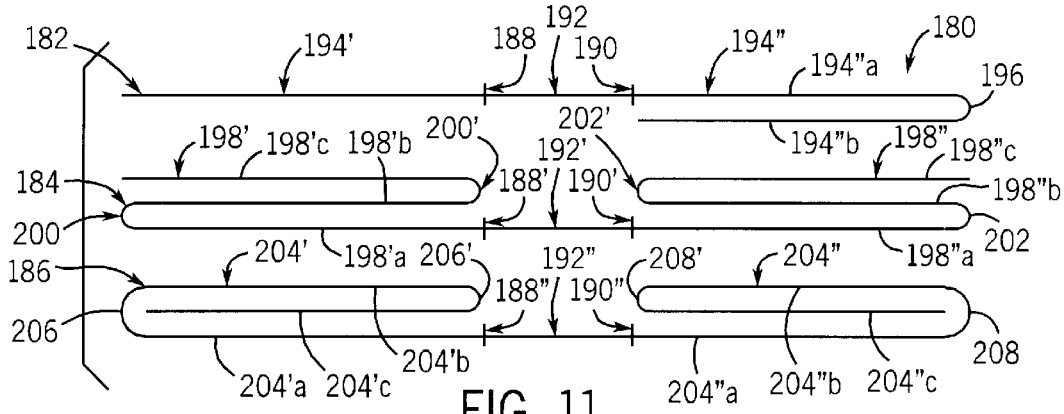
FIG. 11 is an exploded schematic illustration of another embodiment of the present invention.

Shown in FIG. 11, for example, is an exploded, schematic view of one embodiment in accordance with the invention, illustrating the use of a first sheet having a simple fold, a second sheet having two Z-folds, and a third sheet having two roll folds. FIG. 11 shows sheets 182,184, and 186 of booklet 180 without glue. Lines of weakening 188 and 190 are shown for each of sheets 182,184, and 186, where they are designated, respectively, as 188/190, 188'/190', and 188"/190". Central joining portion 192 is shown for sheets 182,184, and 186 as 192,192', and 192". Sheet 182 has a single fold 196 and comprises outer portions 194' and 194". Outer portion 194" is composed of two panels—194"*a* and 194"*b*—separated by fold 196. Sheet 184 comprises two outer portions 198' and 198", each of which is configured as a Z-fold. Outer portion 198' is composed of three panels: 198'*a*, 198'*b*, 198'*c*. Panels 198'*a* and 198'*b* are separated by fold 200; panels 198'*b* and 198'*c* are separated by fold 200'. Outer portion 198" has analogous panels and folds, as it comprises panels 198"*a*, 198"*b*, and 198"*c*. Panels 198"*a* and 198"*b* are separated by fold 202; panels 198"*b* and 198"*c* are separated by fold 202'. Sheet 186 comprises two outer portions 204' and 204", each of which is configured as a roll fold. Outer portion 204' is composed of three panels: 204'*a*, 204'*b*, 204'*c*. Panels 204'*a* and 204'*b* are separated by fold 206; panels 204'*b* and 204'*c* are separated by fold 206'. Outer portion 204" has analogous panels and folds, as it comprises panels 204"*a*, 204"*b*, and 204"*c*. Panels 204"*a* and 204"*b* are separated by fold 208; panels 204"*b* and 204"*c* are separated by fold 208'.

Figure 12:
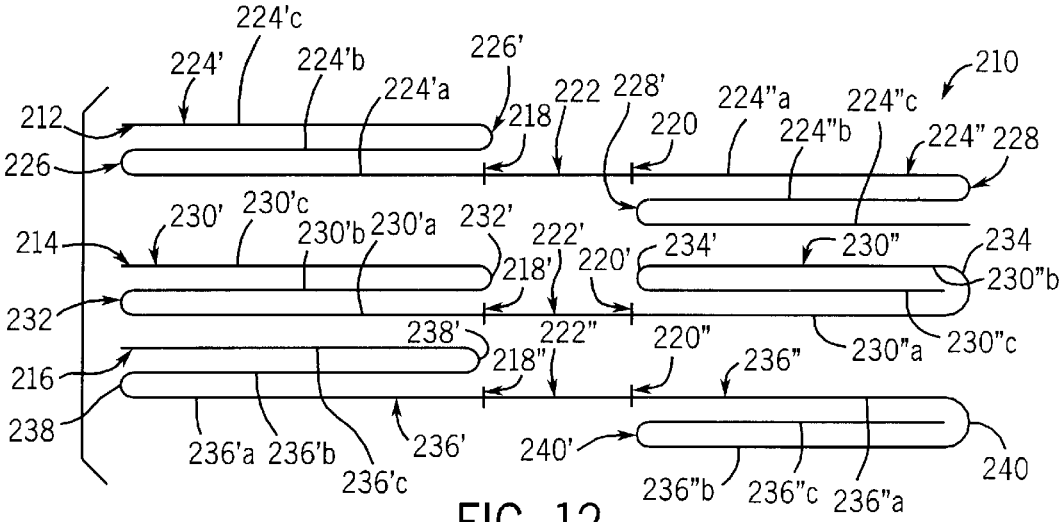
FIG. 12 is an exploded schematic illustration of another embodiment of the present invention.

In FIG. 12, yet another embodiment is depicted in accordance with the invention. The embodiment shown illustrates the use of a first sheet having two Z-folds directed toward opposite sides of the sheet, a second sheet having one Z-fold and one roll fold directed toward the same side of the sheet, and a third sheet having one Z-fold and one roll fold directed toward opposite sides of the sheet. FIG. 12 shows sheets 212, 214, and 216 of booklet 210 without glue. Lines of weakening 218 and 220 are shown for each of sheets 212, 214, and 216, where they are designated, respectively, as 218/220, 218'/220', and 218"/220". Central joining portion 222 is shown for sheets 212, 214, and 216 as 222, 222', and 222". Sheet 212 comprises two outer portions, 224' and 224", each being a Z-fold directed toward a different surface. Outer portion 224' is composed of three panels: 224'*a*, 224'*b*, and 224'*c*. Panels 224'*a* and 224'*b* are separated by fold 226; panels 224'*b* and 224'*c* are separated by fold 226'. Outer portion 224" has analogous panels and folds, as it comprises panels 224"*a*, 224"*b*, and 224"*c*. Panels 224"*a* and 224"*b* are separated by fold 228; panels 224"*b* and 224"*c* are separated by fold 228'. Sheet 214 comprises two outer portions 230', which is configured as a Z-fold, and 230", which is configured as a roll fold. Outer portion 230' is a Z-fold composed of three panels: 230'*a*, 230'*b*, 230'*c*. Panels 230'*a* and 230'*b* are separated by fold 232; panels 230'*b* and 230'*c* are separated by fold 232'. Outer portion 230" has analogous panels and folds, as it comprises panels 230"*a*, 230"*b*, and 230"*c*. Panels 230"*a* and 230"*b* are separated by fold 234; panels 230"*b* and 230"*c* are separated by fold 234'. Third sheet 216 comprises two outer portions 236', which is configured as a Z-fold, and 236", which is configured as a roll fold that is directed toward the opposite side of the sheet from the Z-fold. Outer portion 236' comprises three panels: 236'*a*, 236'*b*, 236'*c*. Panels 236'*a* and 236'*b* are separated by fold 238; panels 236'*b* and 236'*c* are separated by fold 238'. Outer portion 236" also comprises three panels: 236"*a*, 236"*b*, and 236"*c*. Panels 236"*a* and 236"*b* are separated by fold 240; panels 236"*b* and 236"*c* are separated by fold 240'.

Figure 13:
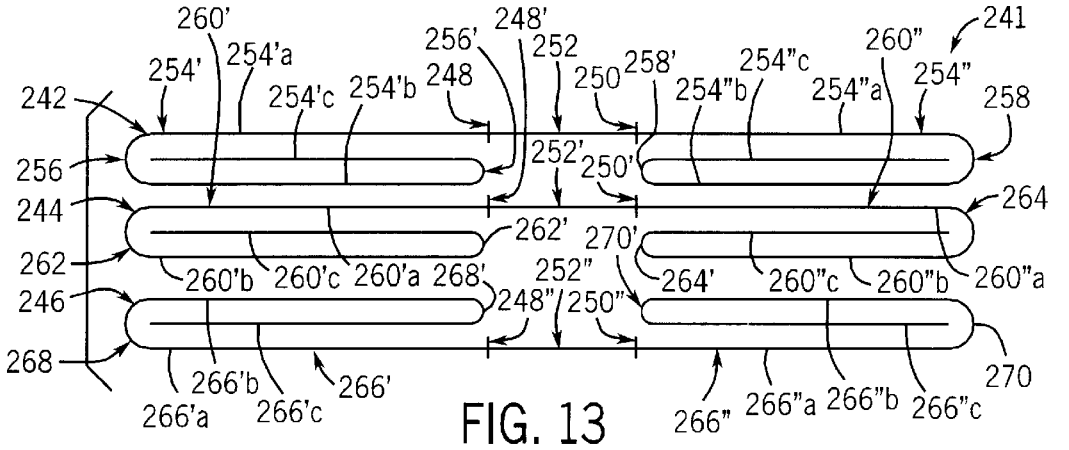
FIG. 13 is an exploded schematic illustration of another embodiment of the present invention.

Also in accordance with the invention is the embodiment shown in FIG. 13, which illustrates the use of three sheets 242, 244, and 246 of booklet 241, each sheet having two roll folds. In this embodiment, the roll folds of top sheet 242 and middle sheet 244 are configured in a downward direction; the roll fold of third sheet 246 is configured in the opposite direction. For each of sheets 242, 244, and 246, lines of weakening 248 and 250 are designated as 248/250, 248'/250', and 248"/250", and central joining portion 252 is shown as 252, 252', and 252", respectively. Outer portions 254' and 254" of sheet 242 are roll folds, each comprising three panels. Outer portion 254' has panels 254'*a*, 254'*b*, and 254'*c* and includes fold 256 separating panels 254'*a* and 254'*b*, and fold 256' separating panels 254'*b* and 254'*c*. Outer portion 254" has panels 254"*a*, 254"*b*, and 254"*c* and fold 258 separating panels 254"*a* and 254"*b* and fold 258' separating panels 254"*b* and 254"*c*. Second sheet 244 is configured similarly to first sheet 242 in that it has outer portions 260' and 260", each of which comprises three panels in a roll fold configuration. Outer portion 260' has fold 262 between panels 260'*a* and 260'*b* and fold 262' between panels 260'*b* and 260'*c*. Outer portion 260" has fold 264 between panels 260"*a* and 260"*b* and fold 264' between panels 260"*b* and 260"*c*. Third sheet 246 has outer portions 266' and 266", also configured as a roll fold but folded in a direction opposite from the roll folds of sheets 242 and 244. Outer portion 266' has panels 266'*a* and 266'*b* separated by fold 268, and panel 266'*c* adjacent fold 268'. Outer portion 266" has analogous panels and folds; i.e., panels 266"*a*, 266"*b*, and 266"*c* where panels 266"*a* and 266"*b* are separated by fold 270 and panels 266"*b* and 266"*c* are separated by fold 270'.

While the invention has been described with respect to certain preferred embodiments, it is to be understood that the invention is capable of numerous changes, modifications, and rearrangements without departing from the scope or spirit of the invention as defined in the claims.

What is claimed is:

1. A booklet comprising:

a) a plurality of sheets, each sheet having a central sheet portion having two longitudinal edge boundaries, and a different outer removable sheet portion flanking a different one of said longitudinal edge boundaries;

b) two longitudinal lines of weakening on each said sheet, each said longitudinal line of weakening defining a different one of said longitudinal edge boundaries as a substantially flat, foldless boundary between the central sheet portion and one of the outer removable sheet portions, each said longitudinal line of weakening suitable to facilitate removal of one of said outer removable sheet portions from said central sheet portion, said central sheet portions overlaying each other; and c) an attachment joining said overlaying central sheet portions to each other.

2. The booklet of claim 1 further comprising:

a third longitudinal line of weakening defining a boundary between at least one periphery of at least one of said sheets and an attachable sheet portion, said third longitudinal line of weakening being suitable to facilitate the removal of said attachable sheet portion from said at least one periphery of at least one of said sheets.

3. The booklet of claim 1 wherein the sheets are formed from a web.

4. The booklet of claim 1 wherein the sheets are paper.

5. The booklet of claim 1 wherein the sheets comprise different materials.

6. The booklet of claim 1 wherein said outer removable portions are of equal width.

7. The booklet of claim 1 wherein said outer removable portions are of unequal width.

8. The booklet of claim 1 wherein each said longitudinal line of weakening defining a boundary between a central sheet portion and an outer removable sheet portion comprises perforations.

9. The booklet of claim 1 wherein each said longitudinal line of weakening defining a boundary between a central sheet portion and an outer removable sheet portion comprises a line of weakness.

10. The booklet of claim 1 wherein each said attachment joining said sheets about said central sheet portions comprises an adhesive.

11. The booklet of claim 1 wherein each said attachment joining said sheets about said central sheet portions comprises at least one staple.

12. The booklet of claim 1 wherein at least some of the removable sheet portions comprise two or more panels.

13. The booklet of claim 12 wherein the panels are separated by at least one fold.

14. The booklet of claim 1 wherein each said attachment joining said sheets about said central sheet portions comprises at least one tie.

15. The booklet of claim 10 wherein said adhesive is pressure sensitive.

16. The booklet of claim 1 wherein each of the plurality of sheets is unfolded and has no fold lines.

17. The booklet of claim 1 wherein said central sheet portions are substantially coextensive.

18. The booklet of claim 1 wherein at least two sheets differ in shape.

19. A booklet comprising:

a plurality of sheets, each sheet having a generally central sheet portion having two longitudinal edge boundaries and a different outer removable sheet portion flanking a different one of said longitudinal edge boundaries;

two longitudinal lines of weakening on each said sheet, each said longitudinal line of weakening defining a different one of said longitudinal edge boundaries as a substantially flat, foldless boundary between the central sheet portion and one of the outer removable sheet portions, each said longitudinal line of weakening suitable to facilitate removal of one of said outer removable sheet portions from said central sheet portion, said central sheet portion having opposing surfaces, wherein each central sheet portion overlays and is attached to at least a portion of a surface of an adjacent central sheet portion.

20. The booklet of claim 19 further comprising a longitudinal attachment joining adjacent central sheet portions.

21. The booklet of claim 19 wherein said central sheet portions have equal width and are in registry with each other.

22. The booklet of claim 19 wherein each of the sheets are flat and foldless.

* * * * *